US005378189A

United States Patent [19]

Chiu

[11] Patent Number: 5,378,189

[45] Date of Patent: Jan. 3, 1995

[54] WALKING TOY ANIMAL WITH EXTENDING LEG MEMBERS AND OSCILLATING TAIL

[76] Inventor: Chien-Chieh Chiu, P.O. Box 10780 ., Taipei, Taiwan, Prov. of China

[21] Appl. No.: 179,361

[22] Filed: Jan. 7, 1994

[51] Int. Cl.[6] ..... A63H 11/00; A63H 7/00; A63H 33/00

[52] U.S. Cl. ..... 446/353; 446/330; 446/377; 446/489

[58] Field of Search ..... 446/276, 285, 293, 294, 446/316, 317, 330, 353–355, 377, 489

[56] References Cited

U.S. PATENT DOCUMENTS

| | | | |
|---|---|---|---|
| 1,216,906 | 2/1917 | Woolson | 446/276 |
| 2,978,834 | 4/1961 | Gardel et al. | 446/354 |
| 3,568,363 | 3/1971 | Tanimura | 446/293 |
| 3,940,879 | 3/1976 | Glass et al. | 446/276 |
| 4,878,874 | 11/1989 | Terzian | 446/276 |

FOREIGN PATENT DOCUMENTS

| | | | |
|---|---|---|---|
| 620209 | 3/1949 | United Kingdom | 446/294 |
| 2045625 | 11/1980 | United Kingdom | 446/355 |
| 2150450 | 7/1985 | United Kingdom | 446/276 |

*Primary Examiner*—Robert A. Hafer
*Assistant Examiner*—Jeffrey D. Carlson
*Attorney, Agent, or Firm*—Pollock, Vande Sande & Priddy

[57] ABSTRACT

A toy animal which can mimic the walking movement of real animals, including a flexible housing accommodating therein a driving device consisting of a body and various elements supported by the body. These elements include a battery set, a motor, a retarding device, and a main shaft retarded and driven by the retarding device. The main shaft has a cam in the middle thereof, with two eccentric wheels provided at either end of the main shaft. The cam drives a tail rod at a tail shaft of the body to swing left and right, while the two eccentric wheels respectively drive a left foot support and right foot support pivotally disposed on a pair of side shafts at either side of the body to alternately oscillate back and forth. Each foot support has a slide plate which, when the foot support swings forward, projects from the sole and lifts up the foot support so that when the foot support swings backward, a forward thrust force is produced.

8 Claims, 2 Drawing Sheets

FIG. 4
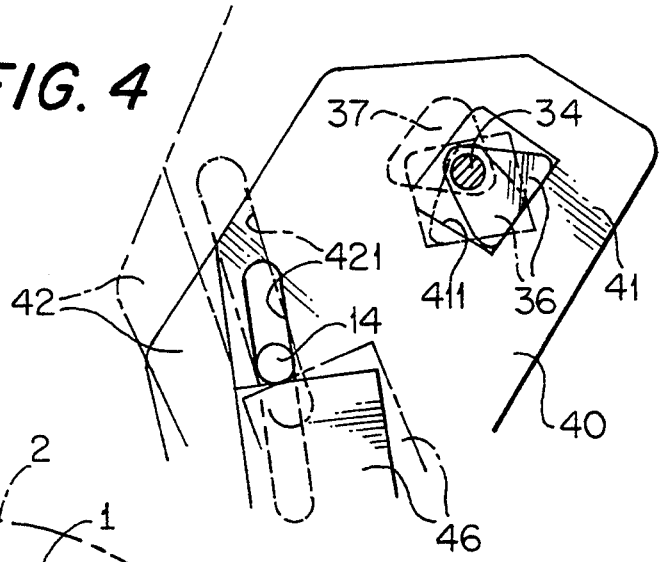
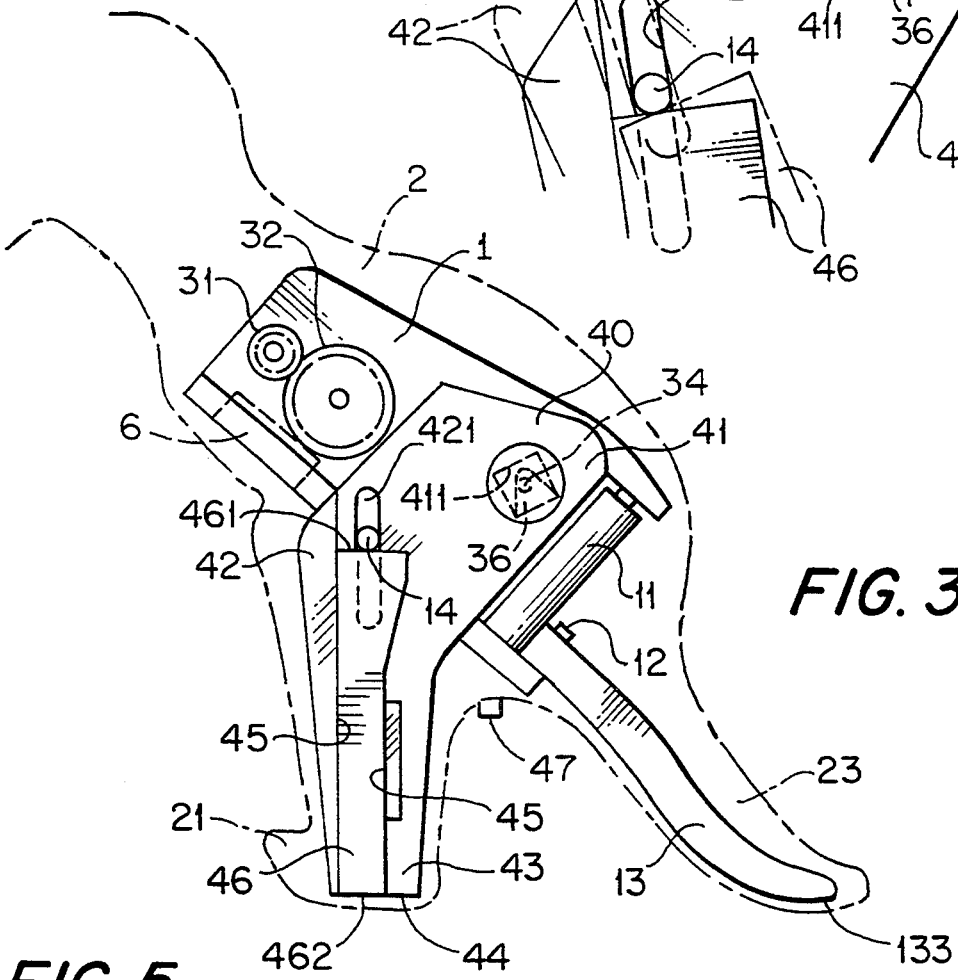
FIG. 3
FIG. 5
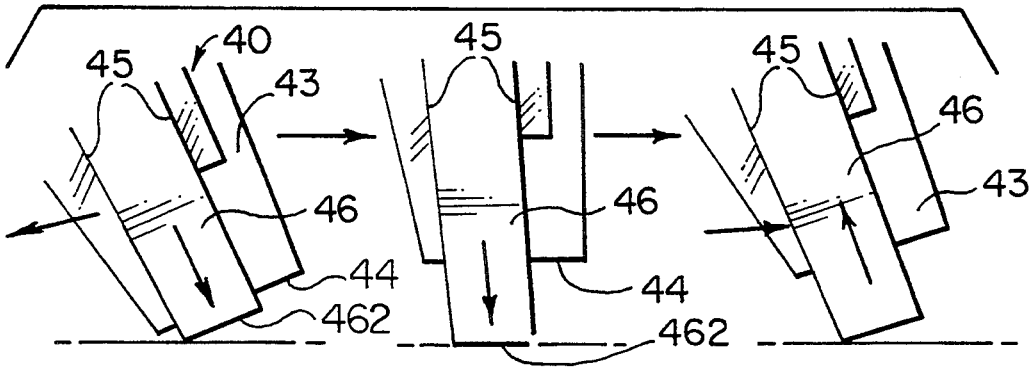

WALKING TOY ANIMAL WITH EXTENDING LEG MEMBERS AND OSCILLATING TAIL

FIELD OF THE INVENTION

The present invention relates generally to a toy animal, and particularly a toy which mimics the walking movement of an animal with a tail.

BACKGROUND OF THE INVENTION

There is a great variety of toys capable of movement; among these, toys which imitate animals' way of walking are also very common. The driving mechanism of these toys (including mechanical animals) consists of a main shaft driving the two feet of the toy animal to move forward and backward alternately, and therefore, the body of the toy appears stiff and dull due to inaction. Besides, the length of the feet of the toy animal is fixed and unchanged, so that when the feet move along the floor, because of the frictional force thus generated, the walking speed of the toy is very slow.

For a toy animal with a tail, such as the dinosaur, the conventional driving device has to further overcome the frictional resistance produced when the tail drags along the floor.

How to eliminate the frictional resistance when toy animals with tails walk along the floor; how to make the step of the toy animal longer; and how to make the body of the toy animal twist more realistically when walking; all these problems point to the direction which manufacturers of toys imitating the walking movement of animals should follow in seeking breakthroughs in conventional designs.

SUMMARY OF THE INVENTION

Therefore, the primary object of the present invention is to provide a toy animal which can produce the imitated movement of lifting up the legs and make the steps longer.

Another object of the present invention is to provide a toy animal having a tail, wherein by means of the support of the tail, the body of the toy may produce twisting movements when walking.

To achieve the above-mentioned objects, the toy animal according to the present invention comprises a flexible housing having therein a driving device which includes a battery set, a motor, a main shaft driven by a retarding device, and a body. The main shaft has a cam in the middle thereof, and two eccentric wheels at either end thereof. The cam drives a tail rod pivotally provided on a tail shaft of the body to oscillate left and right. Two foot supports are each pivotally provided on a pair of side shafts at either side of the body. The eccentric wheels drive their corresponding foot supports to alternately oscillate back and forth. Each foot support has a slide plate which, when the foot support moves forward, projects from the sole of the foot support to lift up the foot support so that when the foot support moves backward, a forward thrust force is generated. Furthermore, when one foot support is lifted, the other foot support and the tail rod can support a large part of the toy's weight. Such alternate movements allow the weight of the toy to alternately move left and right, causing the body of the toy to twist more realistically.

BRIEF DESCRIPTION OF THE DRAWINGS

The foregoing and other features and advantages of the present invention will be more clearly understood from the following detailed description and the accompanying drawings, in which, FIG. 3 is a plan view of the preferred embodiment of the present invention, FIG. 4 is a partial detailed view of the foot support of FIG. 3, illustrating the driving element and the support element, and FIG. 5 is similar to FIG. 4, but showing the action of the driven element.

DETAILED DESCRIPTION OF THE PREFERRED EMBODIMENTS

Although in the accompanying drawings and the below description the dinosaur is used as a preferred embodiment, it is well known that any similar toy animals, with a little modification, may be suitable for the present invention.

Figure 1:
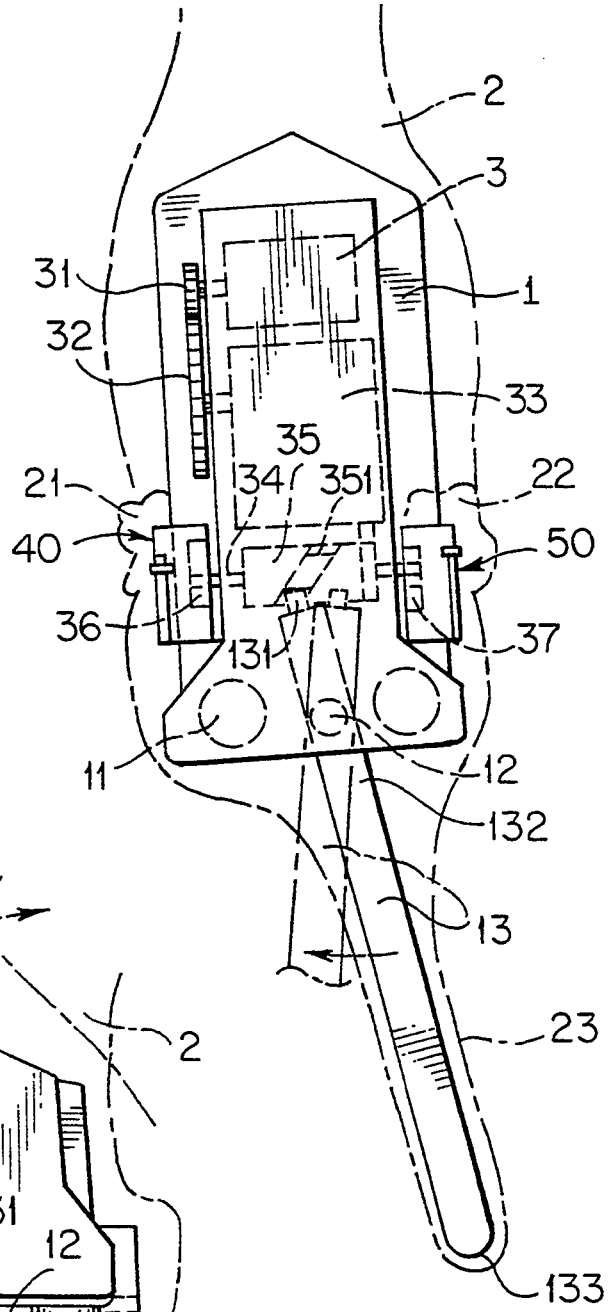
FIG. 1 is a top elevation view of the preferred embodiment of the present invention.
Figure 2:
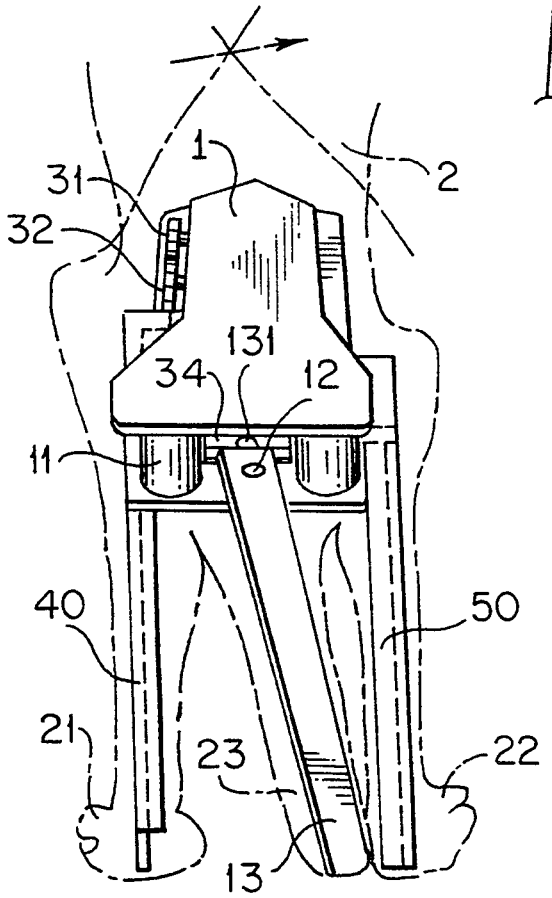
FIG. 2 is a side elevation view of the preferred embodiment of the present invention.

As shown in FIGS. 1, 2, and 3, the preferred embodiment of the toy animal according to the present invention comprises a housing 2 formed of flexible rubber. The housing 2 has accommodated therein a driving device which consists of a body 1 and a plurality of elements supported by the body 1. These elements include a motor 3 for driving a driving gear 31; a retarding device adjacent to the motor 3 and which consists of a driven gear 32 for engaging with the driving gear 31 to receive power therefrom, a retarding element 33, and a main shaft 34 which outputs power retarded by the retarding element 33; and a battery set 11 which includes a switch 47 for controlling and supplying power to the motor 3.

A tail shaft 12 is fixed at the rear end of the body 1 for a girth 132 of a tail rod 13 to be pivotally provided on the tail shaft 12. A cam 35 is fixed in the middle region of the main shaft 34; the cam 35 is preferably a cylindrical cam. A left eccentric wheel 36 and a right eccentric wheel 37 are respectively fixed at either end of the main shaft 34 so that the degree of eccentricity of the two eccentric wheels is, as shown in FIG. 4, approximately 180 degrees.

A pair of side shafts are respectively fixed at the left and right side of the body 1 for supporting a left foot support 40 and a right foot support 50 and pushing the slide plates on the foot supports, to be described hereinafter. Since the left foot support 40 and the right foot support 50 are symmetrical except in their direction; therefore, hereinbelow, only the left foot support 40 shown in FIGS. 4 and 5 is discussed in detail.

The left foot support 40 has a driving element 41, a support element 42, and a driven element 43, wherein the driving element 41 has a hole 411 fitted onto the left eccentric wheel 36; the hole 411 is preferably square and eccentric wheel triangular so as to constitute the complexity of the movements of the left foot support. The support element 42 has a slot 421 fitted onto the side shaft 14 at the left side of the body 1. Additionally, the left foot support 40 has a guide rail 45, with a slide plate 46 fitted therein so that the slide plate 46 may move between the support element 42 and the driven element 43, and the bottom end 462 of the slide plate 46 may project from the sole 44 of the driven element 43.

The slide plate 46 has several features. It reciprocates in a direction parallel to the direction of the slot 421 of the support element 42, and its length is, as shown in FIG. 3, approximately the length from the sole 44 of the left foot support 40 to the middle of the slot 421. In addition, when the driving element 41 of the left foot support 40 is driven by the left eccentric wheel 36 to move forward, the support element 42 of the left foot support 40 will also be lifted, and the slot 421 is consequently lifted so that the fixed side shaft 14, due to relative movement, generates a downward push movement in the slot 421 and pushes against a shoulder 461 of the slide plate 46 so that the slide plate 46 moves down along the guide rail 45 until its bottom end 462 protrudes from the sole 44 of the left foot support 40.

The interaction between the above-mentioned left foot support 40 and the slide plate 46 allows the toy animal to produce the following effects:

(a) The toy animal according to the present invention may mimic the movement of lifting up the feet when an animal walks.

(b) As shown in FIG. 1, a guide pin 131 is disposed at the front end of the tail rod 13, and which is inserted into a notch 351 of the cam 35 so that the tail end 133 of the tail rod 13 oscillates left and right when the cam 35 turns. Under general circumstances, the tail rod 13, the left foot support 40, and the right foot support 50 together support the weight of the toy; but when the slide plate 46 projects from the left foot support 40, a large part of the toy's weight is shifted to the right so that only the right foot support 50 and the tail rod 13 support the toy, which then inclines to the right to produce the simulated movement of an animal twisting to the right while walking.

(c) When the left foot support 40 moves forward, because of the existence of the slide plate 46 which increases the overall length of the left foot support 40, the steps of the toy animal can thus be made longer.

(d) When the left foot support 40 moves backward, the slide plate 46 accordingly moves upward, thus mimicking an animal's bending its legs. At this time, the right foot support 50 makes a forward and lifting movement so that the weight of the toy animal shifts, and a large part of the toy's weight is supported by the left foot support 40 and the tail rod 13, so that the left foot support 40 becomes the supporting point of a reactive force required for the toy animal to walk forward.

Corresponding to the left foot support 40, the right foot support 50 also comprises a driving element, a support element, and a driven element, wherein the driving element of the right foot support 50 has a hole fitted on the right eccentric wheel 37, and the support element of the right foot support 50 has a slot fitted on the side shaft 14 at the right side of the body 1. The right foot support 50 also has a guide rail for a slide plate to be fitted therein and to move between the support element of the right foot support 50 and the driven element of the right foot support 50, and the bottom end of the slide plate of the right foot support 50 may also project from the sole of the driven element of the right foot support 50.

The lower half of the above-mentioned tail rod 13 is largely made of comparatively heavy metal material which may act as an auxiliary weight to stabilize the toy and which may also reinforce the hardness of the tail rod 13. Undoubtedly, the tail rod 13 is for supporting the tail 23 of the toy animal; likewise, the left foot support 40 is for supporting the left leg 21, and right foot support 50 the right leg of the toy animal. Further, to increase the fun in playing, a speaker device 6 may also be disposed on the body 1, as shown in FIG. 3, and which receives current supply from the battery set 11 to produce sound when the toy animal walks.

Although the present invention has been illustrated and described with reference to the preferred embodiments thereof, it should be understood that it is in no way limited to the details of such embodiments, but is capable of numerous modifications within the scope of the appended claims.

What is claimed is:

1. A toy animal with a flexible housing accommodating therein a driving device, said driving device comprising:

a body; and a plurality of elements supported by said body, said elements comprising:

a motor for driving a driving gear;

a retarding device having a driven gear engaging with said driving gear to receive power;

a retarding element; and a main shaft for outputting power retarded by said retarding element;

a battery set having a switch for controlling and supplying electric current to said motor;

a tail shaft fixed at a rear end of said body;

a tail rod with its girth pivotally disposed on said tail shaft;

a cam fixed in the middle region of said main shaft;

a left eccentric wheel and a right eccentric wheel respectively fixed at opposite ends of said main shaft, the degree of eccentrically being 180 degrees;

a pair of side shafts respectively fixed at the right side and left side of said body;

a left foot support having a driving element, a support element, and a driven element, wherein said driving element has a hole fitted on said left eccentric wheel;

said support element has a slot fitted on said side shaft at the left side of said body; and said left foot support further has a guide rail and a slide plate fitted therein to move between said support element and said driven element, a bottom end of said slide plate projecting from a bottom of said driven element; and a right foot support having a driving element, a support element, and a driven element, wherein said driving element of said right foot support has a hole fitted on said right eccentric wheel;

said support element of said right foot support has a slot fitted on said side shaft at the right side of said body; and said right foot support further has a guide rail and a slide plate fitted therein to move between said support element of said right foot support, a bottom end of said driven element of said right foot support, a bottom end of said slide plate of said tight foot support projecting from a bottom of said driven element of said right foot support.

2. A toy animal as claimed in claim 1, wherein both said left eccentric wheel and said right eccentric wheel are triangular structures.

3. A toy animal as claimed in claim 1, wherein both said hole of said left foot support and said hole of said right foot support are square.

4. A toy animal as claimed in claim 1, wherein said slide plate on said left foot support is parallel to said slot of said left foot support and the length of said slide plate of said left foot support is approximately the length from said bottom of said left foot support to the middle of said slot of said left foot support, and said slide plate on said right foot support is parallel to said slot of said right foot support and the length of said slide plate of said right foot support is approximately the length from said bottom of said right foot support to the middle of said slot of said right foot support.

5. A toy animal as claimed in claim 1, wherein said housing is formed of flexible rubber.

6. A toy animal as claimed in claim 1, wherein said elements supported by said body further includes a speaker device which receives current supply from said battery.

7. A toy animal as claimed in claim 1, wherein said tail rod is largely formed of metal so as to act as an auxiliary weight.

8. A toy animal as claimed in claim 1, wherein said left foot support and said right foot support alternately oscillate back and forth and their corresponding slide plate is pressed against by the corresponding side shaft when said left foot support or said right foot support swings forward so that said bottom end of said slide plate projects from said bottom of said left foot support or said right foot support.

* * * * *